US009527300B2

(12) United States Patent
Elferink

(10) Patent No.: US 9,527,300 B2
(45) Date of Patent: Dec. 27, 2016

(54) PRINT HEAD MOUNTING ASSEMBLY

(71) Applicant: OCE-TECHNOLOGIES B.V., Venlo (NL)

(72) Inventor: Maarten J. H. Elferink, Vancouver (CA)

(73) Assignee: OCE-TECHNOLOGIES B.V., Venlo (NL)

( * ) Notice: Subject to any disclaimer, the term of this patent is extended or adjusted under 35 U.S.C. 154(b) by 0 days.

(21) Appl. No.: 14/922,959

(22) Filed: Oct. 26, 2015

(65) Prior Publication Data

US 2016/0039212 A1 Feb. 11, 2016

Related U.S. Application Data

(63) Continuation of application No. PCT/EP2014/058228, filed on Apr. 23, 2014.

(60) Provisional application No. 61/819,247, filed on May 3, 2013.

(51) Int. Cl.

| | |
|---|---|
| ***B41J 2/175*** | (2006.01) |
| ***B41J 2/21*** | (2006.01) |
| ***B41J 25/34*** | (2006.01) |
| ***B41J 25/00*** | (2006.01) |

(52) U.S. Cl.

CPC ..... *B41J 2/1752* (2013.01); *B41J 2/2103* (2013.01); *B41J 25/001* (2013.01); *B41J 25/34* (2013.01)

(58) Field of Classification Search

CPC ..... B41J 2/235; B41J 2/24; B41J 2/245; B41J 2202/14

See application file for complete search history.

(56) References Cited

U.S. PATENT DOCUMENTS

| | | | | |
|---|---|---|---|---|
| 6,796,630 | B2 * | 9/2004 | Ison | B41J 2/14209 347/18 |
| 7,270,387 | B2 * | 9/2007 | Ueda | B41J 2/145 347/37 |
| 8,061,297 | B2 * | 11/2011 | Albertalli | B41J 2/15 101/486 |
| 2010/0231974 | A1 | 9/2010 | Kakigahara et al. | |
| 2011/0001780 | A1 * | 1/2011 | Amidon, Jr. | B41J 2/1752 347/44 |

(Continued)

FOREIGN PATENT DOCUMENTS

| | | | |
|---|---|---|---|
| WO | WO 01/60627 | A2 | 8/2001 |
| WO | WO 2006/116574 | A2 | 11/2006 |
| WO | WO 2010/101034 | A1 | 9/2010 |

*Primary Examiner* — An Do
*Assistant Examiner* — Renee I Wilson
(74) *Attorney, Agent, or Firm* — Birch, Stewart, Kolasch & Birch, LLP

(57) ABSTRACT

A print head mounting assembly for mounting and positioning an inkjet print head on a print head support structure includes a first clamping mechanism for clamping the inkjet print head in a first direction and a second clamping mechanism for clamping the inkjet print head in a second direction, the second direction being substantially perpendicular to the first direction. In order to ease adjustment of the position of the print head, the second clamping mechanism includes an adjustment mechanism for adjusting the position of the print head in the second direction and a release mechanism for releasing the first clamping mechanism, the release mechanism being arranged that the release mechanism is to be operated for operating the adjustment mechanism.

4 Claims, 5 Drawing Sheets

(56) References Cited

U.S. PATENT DOCUMENTS

| | | | | |
|---|---|---|---|---|
| 2011/0149000 | A1 | 6/2011 | Albertalli et al. | |
| 2014/0168319 | A1 * | 6/2014 | Moreau | B41J 2/145<br>347/49 |

* cited by examiner

Fig. 1A
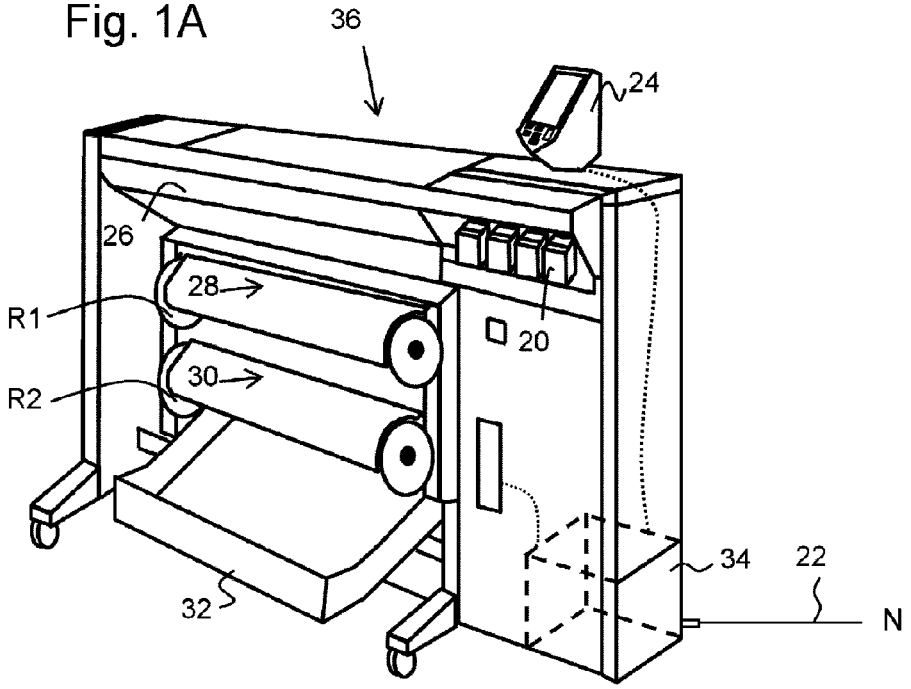
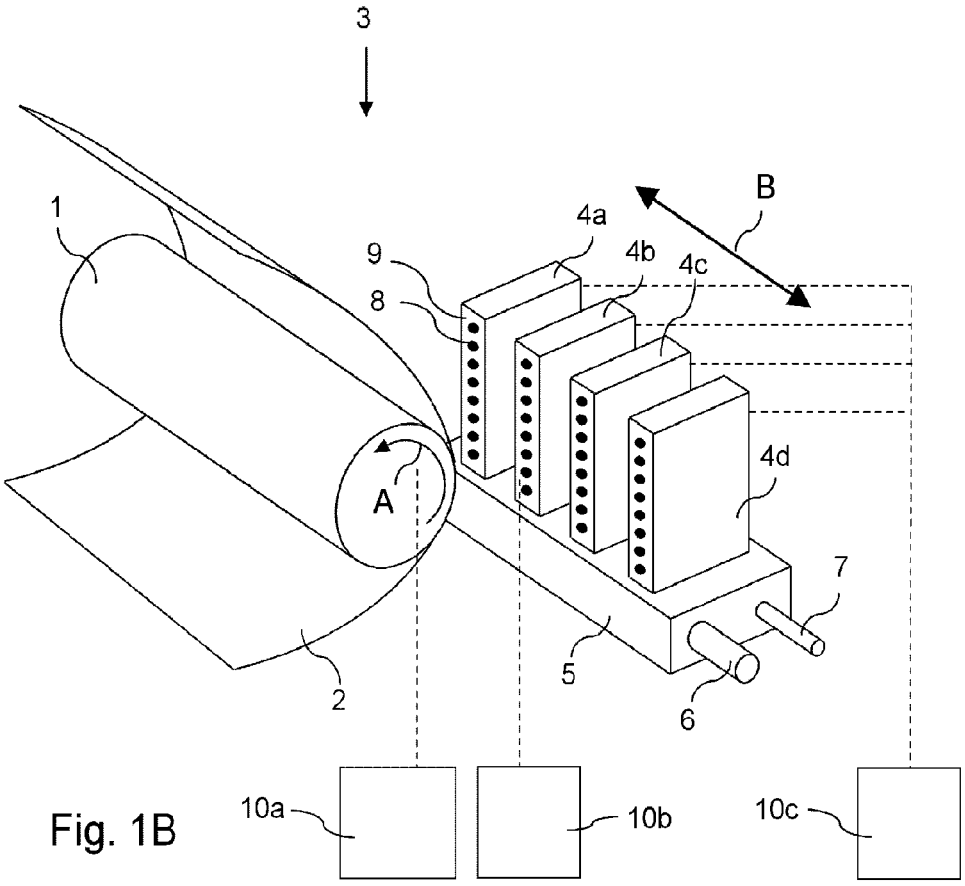
Fig. 1B

PRINT HEAD MOUNTING ASSEMBLY

CROSS REFERENCE TO RELATED APPLICATIONS

This application is a Continuation of PCT International Application No. PCT/EP2014/058228, filed on Apr. 23, 2014, which claims priority under 35 U.S.C. 119(e) to U.S. Provisional Application No. 61/819,247, filed on May 3, 2013, all of which are hereby expressly incorporated by reference into the present application.

FIELD OF THE INVENTION

The present invention generally pertains to an assembly for mounting and positioning a print head on a print head support structure and to a method for mounting and positioning a print head on a print head support structure.

BACKGROUND ART

It is known in the art to arrange a number of print heads, such as inkjet print heads, in an array. The print heads are positioned such that a recording substance, such as inkjet ink, which is recorded through the print head on a recording medium, is positioned on the recording medium accurately thereby enabling to form a high-quality image on the recording medium using the number of print heads. In order to accurately position the recoding substance on the recording medium, the print heads need to be positioned accurately, at least relative to each other.

To accurately position the print heads and to ensure that the print heads remain accurately positioned during use, different kinds of mechanisms have been described and/or employed in the prior art. Known mechanism uses features like a reference surface, a bolt or a spring force and commonly a combination of such features is used.

In practice, the number of print heads may be arranged in a row and the positioning mechanism is relatively easily accessible to a person mounting the print heads. However, the number of print heads in a printer apparatus may be large and the print heads may be arranged in rows and columns, resulting in limited accessibility of the positioning mechanisms of some or all of the print heads. As a result, mounting or replacing a print head may be cumbersome and may require a relatively long time for accurately positioning the large number of print heads. Moreover, in case a print head is defective and needs replacement, a service technician is required to replace the print head, thereby further increasing a cost for replacement.

SUMMARY OF THE INVENTION

In an aspect of the present invention, a print head mounting assembly for mounting and positioning an inkjet print head on a print head support structure according to claim 1 is provided.

The print head mounting assembly according to the present invention comprises a first clamping mechanism for clamping the inkjet print head in a first direction and a second clamping mechanism for clamping the inkjet print head in a second direction, wherein the second direction is substantially perpendicular to the first direction. The second clamping mechanism comprises an adjustment mechanism for adjusting the position of the print head in the second direction and a release mechanism for releasing the first clamping mechanism. The release mechanism is arranged such that the release mechanism is to be operated for operating the adjustment mechanism.

The print head is clamped by a first clamping mechanism and a second clamping mechanism. The first clamping mechanism clamps the print head in a first direction, thereby positioning the print head in said first direction. In a second direction, substantially perpendicular to the first direction, the second clamping mechanism positions the print head.

As the two directions are substantially perpendicular relative to each other, adjusting a position in one of the two directions does not affect the positioning in the other of the two directions. However, the first clamping mechanism is configured to keep the print head positioned accurately and may therefore be presumed to engage the print head and exert a force on the print head. Attempting to adjust the position of the print head in the second direction will be cumbersome due to the force exerted by the first clamping mechanism. A friction resulting from the clamping in the first direction counteracts a movement in the second direction. Moreover, a threshold force needs to be exerted in order to overcome a static friction force, but then, once in movement, the static friction force becomes a dynamic friction force, which is smaller than the static friction force. Hence, controlling the movement and resulting position would be very difficult, as is well known in the art. Therefore, it is preferred to release the first clamping mechanism such that the static friction force is significantly reduced, which in the prior art was performed by a service technician who would release the first clamping mechanism, adjust the second clamping mechanism and then fasten the first clamping mechanism again.

In the present invention, operating the second clamping mechanism comprises operating the release mechanism. So, if and when the second clamping mechanism is operated the release mechanism is operated and the spring load exerted by the first clamping mechanism is released, while the adjustment mechanism of the second clamping mechanism is operated. As soon as the adjustment mechanism is released, the release mechanism is released and the first clamping mechanism is fastened again. Thus, the method to adjust the position in the second direction is significantly simplified and a chance that a mistake, such as not fastening the first clamping mechanism after adjustment, occurs is reduced.

In an embodiment, the first clamping mechanism comprises a reference surface and a spring loaded element, the spring loaded element engaging with a first outer surface of the print head for exerting a spring load such to press a second outer surface of the print head against the reference surface. Hence, an accurate reference surface e.g. arranged on the print head support structure ensures accurate positioning in the first direction. In this embodiment, the release mechanism is arranged to release the spring load from the spring loaded element such that the print head is not pressed against the reference surface thereby reducing the friction between the reference surface and the print head. Consequently, adjusting the position in the second direction becomes enabled. Reapplying the spring load automatically forces the print head against the reference surface, thereby re-positioning the print head in the first direction.

In an embodiment of the mounting assembly according to the invention, the adjustment element comprises an adjustment bolt to be rotated for adjusting the position of the print head in the second direction and wherein the release mechanism comprises an engagement surface arranged near the adjustment bolt such that the engagement surface is to be shifted for enabling operating the adjustment bolt. Shifting the engagement surface results in operating the release mechanism and thus results in release of the first clamping mechanism. Hence, adjusting the position in the second direction by operating the adjustment bolt inevitably requires operating the release mechanism, i.e. releasing the first clamping mechanism.

In a particular embodiment, the adjustment bolt is to be operated by an elongated tool. The adjustment bolt is arranged such that the elongated tool needs to approach the adjustment bolt at an angle. Then, the elongated tool is tilted for operating the adjustment bolt, which results in engaging and shifting the engagement surface, thereby releasing the first clamping mechanism. After adjusting the adjustment bolt, the elongated tool is removed, thereby disengaging the engagement surface and fastening the first clamping mechanism.

Further, in an embodiment, the release mechanism comprises a lever, the lever comprising the engagement surface such that shifting the engagement surface operates the lever and the first clamping mechanism comprises a spring loaded element for exerting a spring load on the print head. The lever is arranged to engage the spring loaded element for releasing the spring load when the lever is operated. This provides a simple and cost-effective embodiment of the print head mounting assembly according to the present invention.

Further scope of applicability of the present invention will become apparent from the detailed description given hereinafter. However, it should be understood that the detailed description and specific examples, while indicating embodiments of the invention, are given by way of illustration only, since various changes and modifications within the scope of the invention will become apparent to those skilled in the art from this detailed description.

BRIEF DESCRIPTION OF THE DRAWINGS

The present invention will become more fully understood from the detailed description given hereinbelow and the accompanying schematical drawings which are given by way of illustration only, and thus are not limitative of the present invention, and wherein:

FIG. 1A is a perspective view of a first exemplary scanning inkjet printing apparatus;

FIG. 1B is a schematic representation of a scanning inkjet printing assembly;

DETAILED DESCRIPTION OF THE DRAWINGS

Figure 1C:
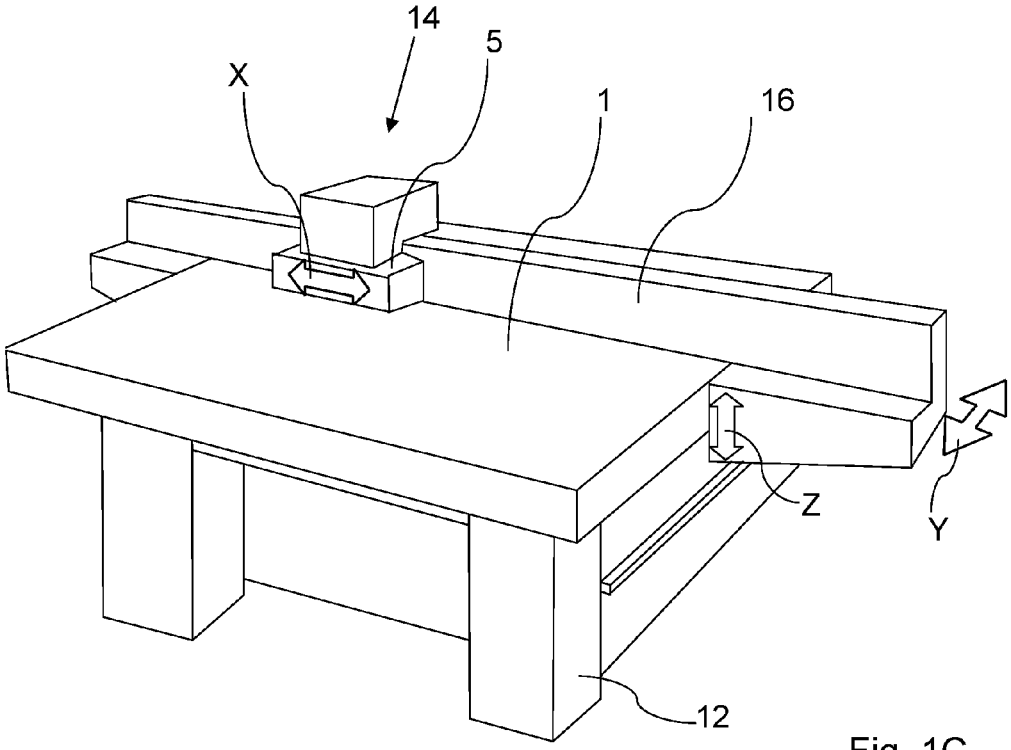
FIG. 1C is a perspective view of a second exemplary scanning inkjet printing apparatus.

The present invention will now be described with reference to the accompanying drawings, wherein the same reference numerals have been used to identify the same or similar elements throughout the several views.

FIG. 1A shows an image forming apparatus 36, wherein printing is achieved using a wide format inkjet printer. The wide-format image forming apparatus 36 comprises a housing 26, wherein the printing assembly, for example the ink jet printing assembly shown in FIG. 1B is arranged. The image forming apparatus 36 also comprises a storage means for storing image receiving member 28, 30, a delivery station to collect the image receiving member 28, 30 after printing and storage means for marking material 20. In FIG. 1A, the delivery station is embodied as a delivery tray 32. Optionally, the delivery station may comprise processing means for processing the image receiving member 28, 30 after printing, e.g. a folder or a puncher. The wide-format image forming apparatus 36 furthermore comprises means for receiving print jobs and optionally means for manipulating print jobs. These means may include a user interface unit 24 and/or a control unit 34, for example a computer.

Images are printed on an image receiving member, for example paper, supplied by a roll 28, 30. The roll 28 is supported on the roll support R1, while the roll 30 is supported on the roll support R2. Alternatively, cut sheet image receiving members may be used instead of rolls 28, 30 of image receiving member. Printed sheets of the image receiving member, cut off from the roll 28, 30, are deposited in the delivery tray 32.

Each one of the marking materials for use in the printing assembly are stored in four containers 20 arranged in fluid connection with the respective print heads for supplying marking material to said print heads.

The local user interface unit 24 is integrated to the print engine and may comprise a display unit and a control panel. Alternatively, the control panel may be integrated in the display unit, for example in the form of a touch-screen control panel. The local user interface unit 24 is connected to a control unit 34 placed inside the printing apparatus 36. The control unit 34, for example a computer, comprises a processor adapted to issue commands to the print engine, for example for controlling the print process. The image forming apparatus 36 may optionally be connected to a network N. The connection to the network N is diagrammatically shown in the form of a cable 22, but nevertheless, the connection could be wireless. The image forming apparatus 36 may receive printing jobs via the network. Further, optionally, the controller of the printer may be provided with a USB port, so printing jobs may be sent to the printer via this USB port.

FIG. 1B shows an ink jet printing assembly 3. The ink jet printing assembly 3 comprises supporting means for supporting an image receiving member 2. The supporting means are shown in FIG. 1B as a platen 1, but alternatively, the supporting means may be a flat surface. The platen 1, as depicted in FIG. 1B, is a rotatable drum, which is rotatable about its axis as indicated by arrow A. The supporting means may be optionally provided with suction holes for holding the image receiving member in a fixed position with respect to the supporting means. The ink jet printing assembly 3 comprises print heads 4*a*-4*d*, mounted on a scanning print head carriage 5. The scanning print head carriage 5 is guided by suitable guiding means 6, 7 to move in reciprocation in the main scanning direction B. Each print head 4*a*-4*d* comprises an orifice surface 9, which orifice surface 9 is provided with at least one orifice 8. The print heads 4*a*-4*d* are configured to eject droplets of marking material onto the image receiving member 2. The platen 1, the carriage 5 and the print heads 4*a*-4*d* are controlled by suitable controlling means 10*a*, 10*b* and 10*c*, respectively.

The image receiving member 2 may be a medium in web or in sheet form and may be composed of e.g. paper, cardboard, label stock, coated paper, plastic or textile. Alternatively, the image receiving member 2 may also be an intermediate member, endless or not. Examples of endless members, which may be moved cyclically, are a belt or a drum. The image receiving member 2 is moved in the sub-scanning direction A by the platen 1 along four print heads 4*a*-4*d* provided with a fluid marking material.

The scanning print head carriage 5 carries the four print heads 4*a*-4*d* and may be moved in reciprocation in the main scanning direction B parallel to the platen 1, such as to enable scanning of the image receiving member 2 in the main scanning direction B. Only four print heads 4*a*-4*d* are depicted for demonstrating the invention. In practice an arbitrary number of print heads may be employed. In any case, at least one print head 4*a*-4*d* per color of marking material is placed on the scanning print head carriage 5. For example, for a black-and-white printer, at least one print head 4*a*-4*d*, usually containing black marking material is present. Alternatively, a black-and-white printer may comprise a white marking material, which is to be applied on a black image-receiving member 2. For a full-color printer, containing multiple colors, at least one print head 4*a*-4*d* for each of the colors, usually black, cyan, magenta and yellow is present. Often, in a full-color printer, black marking material is used more frequently in comparison to differently colored marking material. Therefore, more print heads 4*a*-4*d* containing black marking material may be provided on the scanning print head carriage 5 compared to print heads 4*a*-4*d* containing marking material in any of the other colors. Alternatively, the print head 4*a*-4*d* containing black marking material may be larger than any of the print heads 4*a*-4*d*, containing a differently colored marking material.

The print head carriage 5 is guided by guiding means 6, 7. These guiding means 6, 7 may be rods as depicted in FIG. 1B. The rods may be driven by suitable driving means (not shown). Alternatively, the print head carriage 5 may be guided by other guiding means, such as an arm being able to move the print head carriage 5. Another alternative is to move the image receiving material 2 in the main scanning direction B.

Each print head 4*a*-4*d* comprises an orifice surface 9 having at least one orifice 8, in fluid communication with a pressure chamber containing fluid marking material provided in the print head 4*a*-4*d*. On the orifice surface 9, a number of orifices 8 is arranged in a single linear array parallel to the sub-scanning direction A. Eight orifices 8 per print head 4*a*-4*d* are depicted in FIG. 1B, however obviously in a practical embodiment several hundreds of orifices 8 may be provided per print head 4*a*-4*d*, optionally arranged in multiple arrays. As depicted in FIG. 1B, the respective print heads 4*a*-4*d* are placed parallel to each other such that corresponding orifices 8 of the respective print heads 4*a*-4*d* are positioned in-line in the main scanning direction B. This means that a line of image dots in the main scanning direction B may be formed by selectively activating up to four orifices 8, each of them being part of a different print head 4*a*-4*d*. This parallel positioning of the print heads 4*a*-4*d* with corresponding in-line placement of the orifices 8 is advantageous to increase productivity and/or improve print quality. Alternatively multiple print heads 4*a*-4*d* may be placed on the print carriage adjacent to each other such that the orifices 8 of the respective print heads 4*a*-4*d* are positioned in a staggered configuration instead of in-line. For instance, this may be done to increase the print resolution or to enlarge the effective print area, which may be addressed in a single scan in the main scanning direction. The image dots are formed by ejecting droplets of marking material from the orifices 8.

Upon ejection of the marking material, some marking material may be spilled and stay on the orifice surface 9 of the print head 4*a*-4*d*. The ink present on the orifice surface 9, may negatively influence the ejection of droplets and the placement of these droplets on the image receiving member 2. Therefore, it may be advantageous to remove excess of ink from the orifice surface 9. The excess of ink may be removed for example by wiping with a wiper and/or by application of a suitable anti-wetting property of the surface, e.g. provided by a coating.

FIG. 1C shows another embodiment of an image forming apparatus 14 (herein also referred to as a printing apparatus), in which the medium supporting means 1 is a flat surface. On the flat surface a non-flexible flat medium may be arranged and may be printed on. The medium supporting means 1 is supported on a suitable support structure 12 and a carriage guiding assembly 16 is arranged over the medium supporting means 1. Such carriage guiding assembly 16 is also known in the art as a gantry. The carriage guiding assembly supports the print head carriage 5 such that the print head carriage 5 is enabled to scan in an X-direction. The carriage guiding assembly 16 is arranged and configured to be enabled to reciprocate in a Y-direction, wherein the Y-direction is usually substantially perpendicular to the X-direction. In a known printing apparatus 14, the carriage guiding assembly 16 is also arranged and configured to be enabled to move in a Z-direction, which is substantially perpendicular to the X-direction and the Y-direction such to enable to adapt the printing apparatus 14 to a thickness of the recording medium being arranged on the medium supporting surface 1.

Figure 1D:
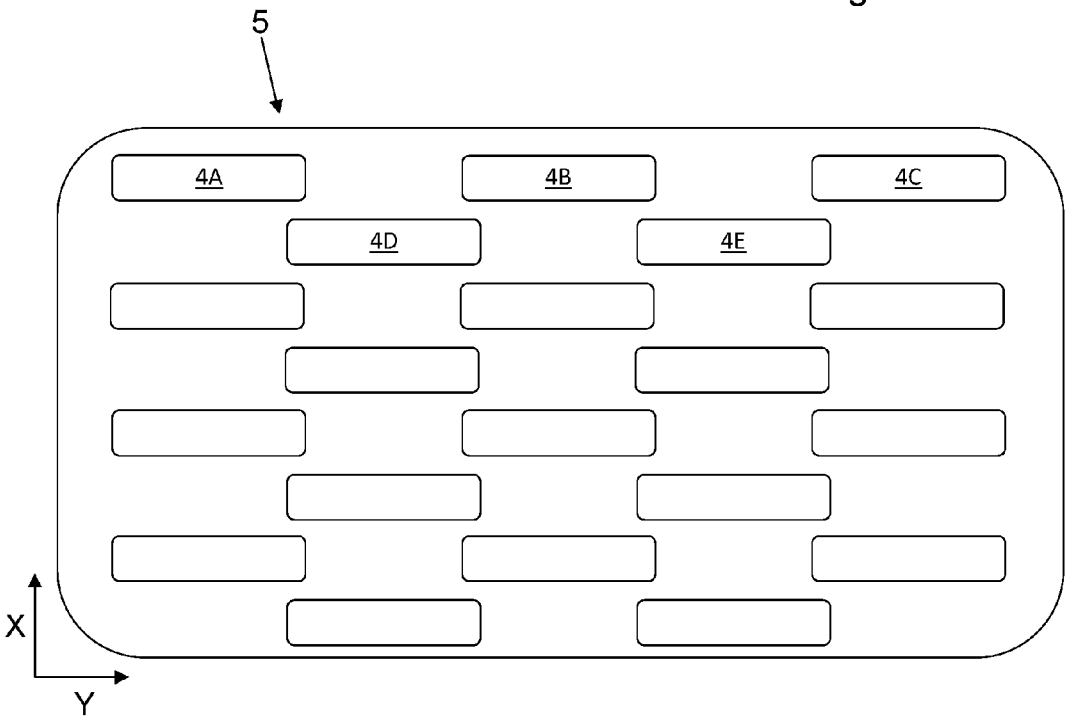
FIG. 1D is a schematic top view of an exemplary print head carriage suitable for use in the printing apparatus according to FIG. 1A and/or FIG. 10.
Figure 2A:
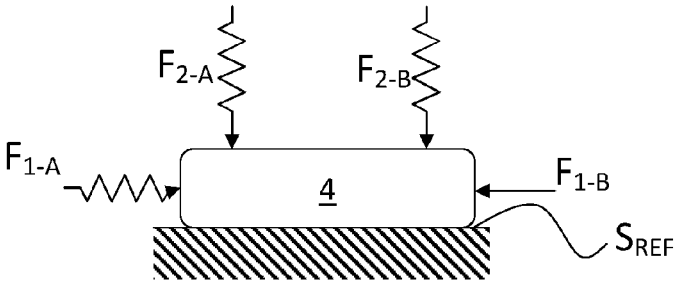
FIG. 2A-2D are schematic representations of a print head mounting assembly suitable for use in accordance with the present invention.

FIG. 1D shows a top view of an exemplary print head carriage 5 having four rows of five print heads 4A-4E arranged thereon. The five print heads 4A-4E are positioned and calibrated relative to each other such that the five print heads 4A-4E are enabled to print adjacent swaths of ink dots, when the print head carriage 5 is moved in the X-direction. In order to prevent, or at least diminish, any visible banding at the print head swath edges and considering that the ink dots may have a diameter in the order of only several microns, the five print heads 4A-4E need to be positioned highly accurately in the Y-direction. A similar reasoning applies with respect to positioning in the X-direction. Hence, as is well known in the art, it is desirable that the print head carriage 5 is provided with suitable means for highly accurately positioning the print heads in one or more directions. Accurate print head positioning and means thereto are known from the prior art. However, most if not all are concerned with accurate positioning but are not concerned with usability. For example, with reference to the exemplary print head carriage 5 of FIG. 1D, replacing a print head and adjusting its position relative to the other print heads may prove difficult due to the very limited space around each print head. Taking into account that usually a number of tubes and/or electrical cables are connected to each print head, it is apparent that replacing and positioning a print head may not only be difficult and time consuming, but may also be a source of errors and ink leakage. FIG. 2A illustrates an embodiment of a print head mounting assembly suitable for accurately positioning a print head 4 in a first direction and in a second direction, the second direction being substantially perpendicular to the first direction. The print head 4 is positioned in the first direction against a reference surface $S_{REF}$ being urged against the reference surface $S_{REF}$ by a first spring force $F_{2-A}$, and a second spring force $F_{2-B}$. So, positioning accuracy is provided by the accuracy of the reference surface $S_{REF}$. An exemplary arrangement for providing such spring forces is shown in FIG. 2B-2C which are described and elucidated hereinbelow.

In the second direction there is no reference position available. The positioning of the print head 4 in the second direction is free such to enable registering with other pint heads. Thereto, in the second direction, a third spring force $F_{1-A}$ is provided. By urging the print head 4 against the third spring force $F_{1-A}$ using a counter force $F_{1-B}$ the print head 4 may be positioned. An exemplary arrangement for providing such spring force and counter force is shown in FIG. 2D which is described and elucidated hereinbelow.

Figure 2B:
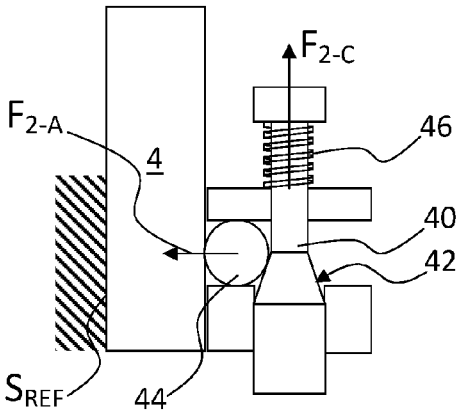
Figure 2C:
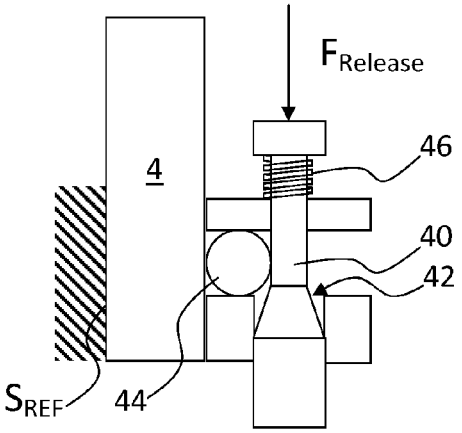

FIGS. 2B and 2C illustrate an arrangement for releasably urging a print head 4 against the reference surface $S_{REF}$. FIG. 2B illustrates a state in which the print head 4 is urged against the reference surface $S_{REF}$. A releasable adjustment bolt 40 has a conical section 42 and the conical section 42 is urged against a first ball-shaped element 44 by a spring element 46 providing a spring load $F_{2-C}$. As a result the first ball-shaped element 44 is urged towards the reference surface $S_{REF}$, thereby urging the print head 4 against the reference surface $S_{REF}$.

In FIG. 2C, a release force $F_{Release}$ is exerted on the releasable adjustment bolt 40, overcoming the spring load $F_{2-C}$, thereby disengaging the first ball-shaped element 44 from the conical section 42. The first ball-shaped element 44 is no longer urged towards the reference surface $S_{REF}$ and consequently the print head 4 is no longer urged against the reference surface $S_{REF}$.

Figure 2D:
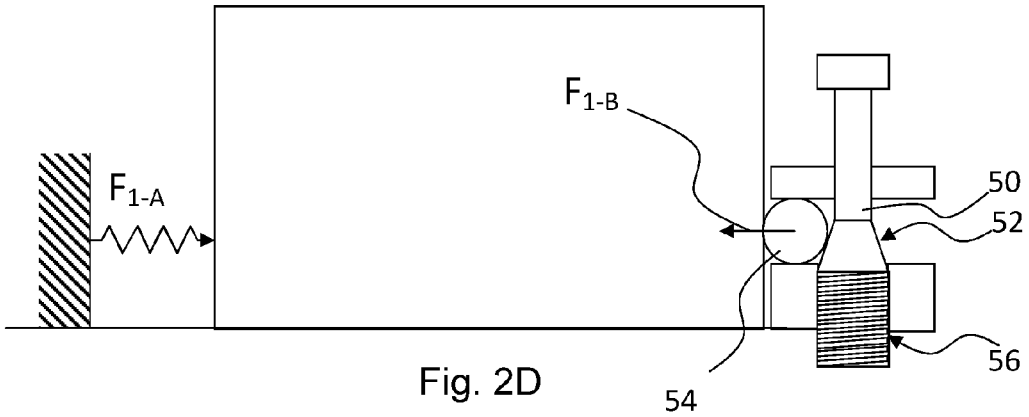

In FIG. 2D, an exemplary arrangement for positioning in the second direction is schematically illustrated. The third spring force $F_{1-A}$ engages the print head 4 and urges the print head 4 against a second ball-shaped element 54. The position of the second ball-shaped element 54 is determined by a fixateable adjustment bolt 50 having a conical section 52. The fixateable adjustment bolt 50 has a threaded section 56 such that rotating the fixateable adjustment bolt 50 determines the position of the conical section 52. As the conical section 52 engages the second ball-shaped element 54, the position of the second ball-shaped element 54 is determined by the position of the conical section 52. Hence, the vertical position of the fixateable adjustment bolt 50 determines the counter force $F_{1-B}$ and thus determines the position of the print head 4 in the second direction.

Note that for accurate positioning, in accordance with generally known mechanical principles, a friction between the reference surface $S_{REF}$ and the print head 4 should be absent. Therefore, the spring forces $F_{2-A}$ and $F_{2-B}$ should be released. For that reason, the releasable adjustment bolt 40 as illustrated in FIG. 2B-2C may be provided for ease of such release of friction. In accordance with the present invention, such release of friction is enabled to be performed upon operating the fixateable adjustment bold 50.

FIG. 3 and FIG. 4A-4C illustrate an embodiment of such a print head mounting assembly according to the present invention. Note that in FIG. 3 and FIG. 4A-4C the print head mounting assembly is shown in isolation, meaning that elements not relevant for elucidating the print head mounting assembly are omitted in order to more clearly show and demonstrate the print head mounting assembly. For example, a mounting plate on which the print head 4 is arranged is omitted; the mounting holes for holding the adjustment bolts are omitted; the reference surface $S_{REF}$ is omitted. Of course, in practice, such elements will need to be present.

Figure 3:
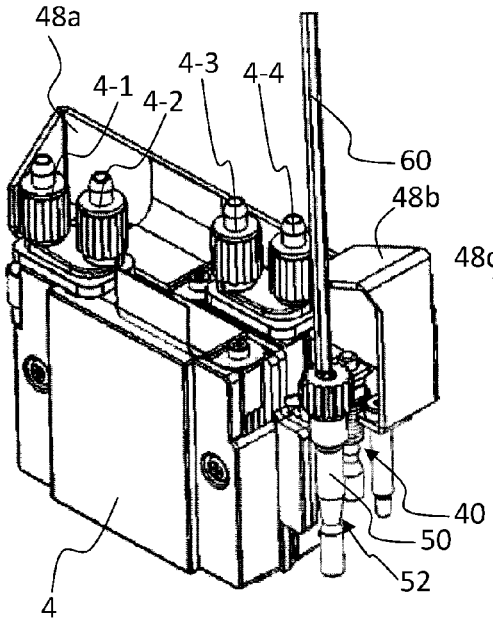
FIG. 3 is a perspective view of a print head arranged in a first embodiment of the print head mounting assembly according to the present invention.

FIG. 3 shows in perspective view a print head 4 having tube connectors 4-1-4-4 on top. In the perspective view of FIG. 3, a flat side surface of the print head 4 is shown in front. This flat side surface is to be urged against the reference surface $S_{REF}$ (not shown) by a first clamping mechanism. The first clamping mechanism comprises the releasable adjustment bolt 40 and the first ball-shaped element 44 (FIG. 2B) and the spring element 46 (FIG. 2B).

A second clamping mechanism comprises the fixateable adjustment bolt 50 having the conical section 52. The second clamping mechanism also comprises the second ball-shaped element 54 (FIG. 2D).

Further, the second clamping mechanism comprises a release mechanism for releasing the first clamping mechanism. The release mechanism comprises a plate-like main body 48*a* having sufficient stiffness to be rotated and to operate the releasable adjustment bolt 40 such to release the first clamping mechanism. The first clamping mechanism further comprises a lever 48*b* with an engagement surface to be engaged with an elongated tool 60. The release mechanism is held in place by holding elements 48*c*. The plate-like main body 48*a* is configured to tilt at a location where the plate-like main body 48*a* is held by the holding elements 48*c*, when the lever 48*b* is shifted by the elongated tool 60. This is demonstrated in more detail in FIG. 4A-4C.

Figure 4A:
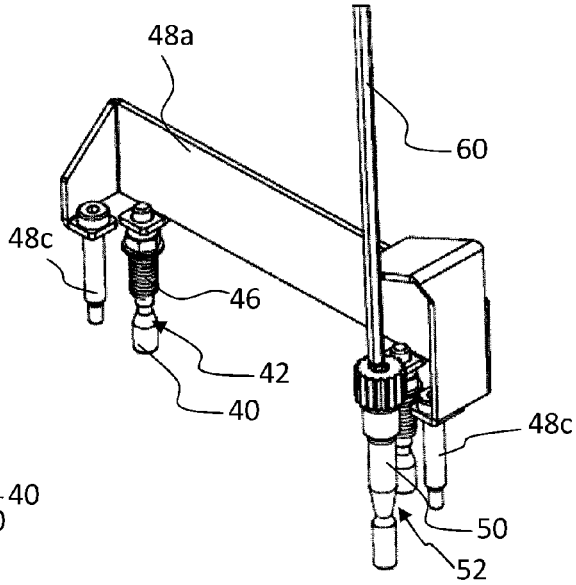
FIG. 4A is a perspective view of the first embodiment of the print head mounting assembly according to the present invention.

FIG. 4A shows the first clamping mechanism with the releaseable adjustment bolt 40 having the conical section 42 and the spring element 46. The second clamping mechanism comprising the fixateable adjustment bolt 50 having the conical section 52 is also shown. The fixateable adjustment bolt 50 is engaged by the elongated tool 60. Further, the release mechanism is illustrated having the plate-like main body 48*a*, the lever 48*b* engaged by the elongated tool 60 at its engagement surface, and the holding elements 48*c*. Note that FIG. 4A is similar to FIG. 3 except that the print head 4 is omitted.

Figure 4B:
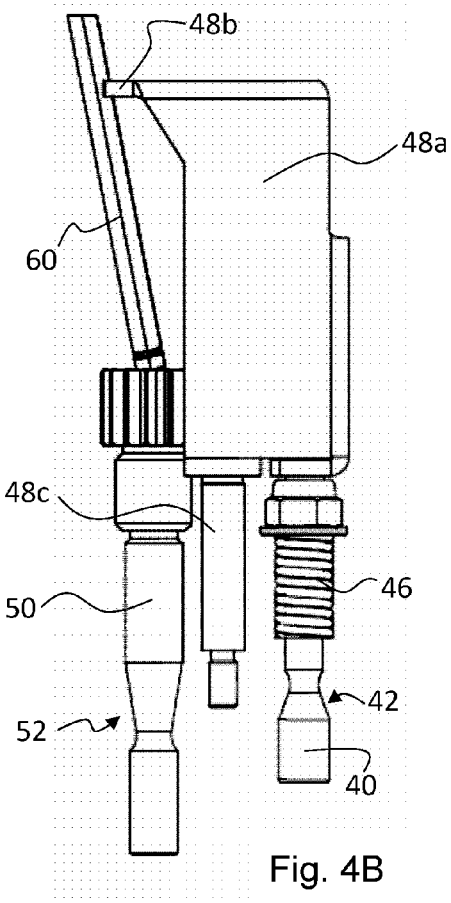
FIG. 4B-4C are a side view of the first embodiment for illustrating the operation of the first embodiment.

FIG. 4B shows the release mechanism in a side view. In the illustrated view, the first clamping mechanism is in a state corresponding to the state in which the clamping mechanism shown in FIG. 2B is. Hence, the first clamping mechanism is in a state for urging a print head against the reference surface.

Figure 4C:
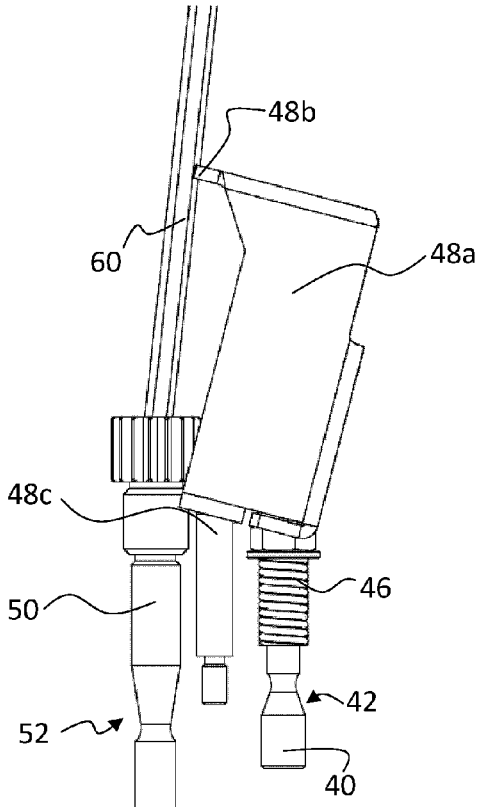

FIG. 4C shows the release mechanism in a side view. In the illustrated view, the first clamping mechanism is in a state corresponding to the state in which the clamping mechanism shown in FIG. 2C is. Hence, the first clamping mechanism is in a state in which a print head is not urged against the reference surface, allowing adjustment of the position in the second direction.

In FIG. 4B, a tip of the elongated tool 60 engages the fixateable adjustment bolt 50 at an angle, thereby engaging the lever 48*b* at the engagement surface. In FIG. 4C, the elongated tool 60 has been introduced into an engagement hole in the top of the fixateable adjustment bolt 50. Such introduction of the elongated tool 60 into the engagement hole requires the elongated tool 60 to be tilted to come in a position in which it extends in a substantially same direction as the fixateable adjustment bolt 50. In order to come to such a position, the elongated tool 60 needs to shift the lever 48*b* by pushing against the engagement surface thereof. Due to the shifting of the lever 48*b*, while being held in position by the holding elements 48*c*, the plate-like main body 48*a* is tilted, thereby operating the releasable adjustment bolts 40. Consequently, upon introducing the elongated tool 60 into the engagement hole of the fixateable adjustment bolt 50, the releasable adjustment bolt 40 is operated, thereby releasing the first clamping mechanism, and the positioning in the second direction can only be performed while the clamping in the first direction is released. Moreover, when the print head has been positioned in the second direction, the elongated tool 60 is disengaged from the fixateable adjustment bolt 50 and as a result the plate-like main body 48*a* of the release mechanism disengages the releasable adjustment bolts 40, thereby re-introducing the clamping force of the first clamping mechanism.

Figure 5:
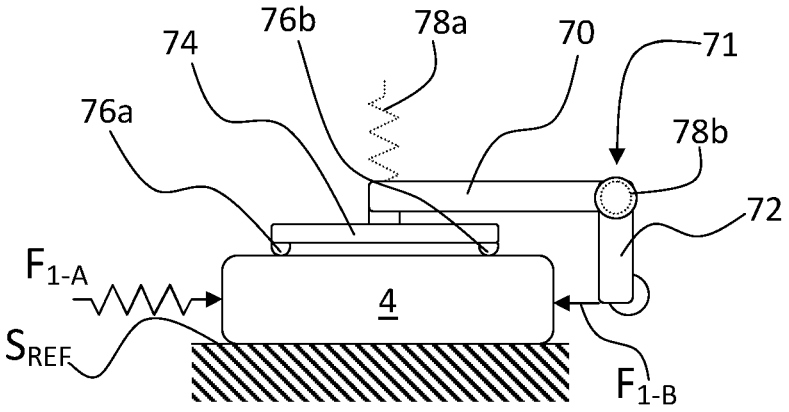
FIG. 5 is a schematic representation of a second embodiment of a print head mounting assembly according to the present invention.

FIG. 5 illustrates a second embodiment of a print head mounting assembly according to the present invention. In the first direction, the print head 4 is urged against the reference surface $S_{REF}$. Positioning in the second direction results from the application of the forces $F_{1\text{-}A}$ and $F_{1\text{-}B}$ as illustrated in and described in relation to FIG. 2D and is not shown and described in detail here. The force $F_{1\text{-}B}$ is adjustable by operating an operating element 72, which may be a bolt, as described hereinabove, or may be any other suitable element.

For urging the print head 4 against the reference surface $S_{REF}$ an elongated structure 74 having spherical engagement elements 76*a* and 76*b* is provided. The elongated structure 74 is urged towards the reference surface $S_{REF}$ to urge the print head against the reference surface $S_{REF}$. The elongated structure 74 is coupled to a lever having a first lever element 70*a* and a second lever element 70*b*. The lever with its lever elements 70*a*, 70*b* is rotatably supported at a turning point 71.

For exerting a clamping force, a spring element is provided. Such a spring element may be a spring 78*a* or may be a torsion spring element 78*b* arranged at the turning point 71. Other spring elements may be provided as well or instead, as will be recognized by the person skilled in the art.

The second lever element 70*b* is arranged over the operating element 72, requiring the second lever element 70*b* to be shifted in order to be able to operate the operating element 72. When the second lever element 70*b* is urged and shifted towards the print head 4, the first lever element 70*a* is urged to move away from the print head 4 against the spring force, thereby releasing the clamping force exerted by the elongated structure 74 in accordance with the present invention.

Figure 6:
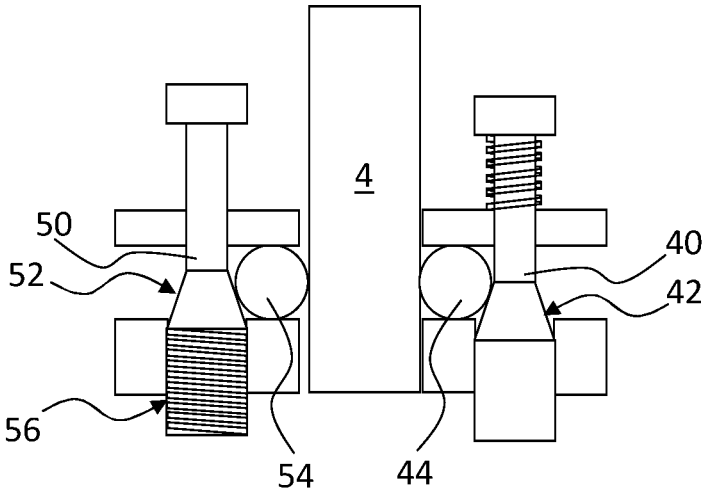
FIG. 6 is a schematic representation of another print head mounting assembly suitable for use in accordance with the present invention.

FIG. 6 illustrates a particular embodiment of a mounting and positioning assembly for positioning a print head 4. The embodiment according to FIG. 6 combines sub-assemblies of the assemblies shown in FIG. 2B-2D. Essentially, it may be considered that the fixateable adjustment bolt 50 with conical section 52 and the second ball-shaped element 54 provide an adjustable reference surface against which the print head 4 is urged by the assembly comprising the releasable adjustment bolt 40 with conical section 42 and the first ball-shaped element 44. This arrangement may be applied for positioning the print head 4 in the first direction and/or in the second direction depending on the requirements, as will be understood by the skilled person.

Detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure. In particular, features presented and described in separate dependent claims may be applied in combination and any advantageous combination of such claims is herewith disclosed.

Further, the terms and phrases used herein are not intended to be limiting; but rather, to provide an understandable description of the invention. The terms "a" or "an", as used herein, are defined as one or more than one. The term plurality, as used herein, is defined as two or more than two. The term another, as used herein, is defined as at least a second or more. The terms including and/or having, as used herein, are defined as comprising (i.e., open language). The term coupled, as used herein, is defined as connected, although not necessarily directly.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

The invention claimed is:

1. A print head mounting assembly for mounting and positioning an inkjet print head on a print head support structure, the print head mounting assembly comprising:

a first clamping mechanism for clamping the inkjet print head in a first direction; and a second clamping mechanism for clamping the inkjet print head in a second direction, the second direction being substantially perpendicular to the first direction., wherein the second clamping mechanism comprises:

an adjustment mechanism for adjusting the position of the print head in the second direction, and a release mechanism for releasing the first clamping mechanism, and wherein the release mechanism is arranged such that the release mechanism is operated while operating the adjustment mechanism, wherein the release mechanism is arranged such that the release mechanism is released when the adjustment mechanism is released, wherein the first clamping mechanism comprises a reference surface and a spring loaded element, the spring loaded element engaging with a first outer surface of the print head for exerting a spring load such to press a second outer surface of the print head against the reference surface, and wherein the release mechanism is arranged to release the spring load from the spring loaded element.

2. A print head mounting assembly for mounting and positioning an inkjet print head on a print head support structure, the print head mounting assembly comprising:

a first clamping mechanism for clamping the inkjet print head in a first direction; and a second clamping mechanism for clamping the inkjet print head in a second direction, the second direction being substantially perpendicular to the first direction, wherein the second clamping mechanism comprises:

an adjustment mechanism for adjusting the position of the print head in the second direction, and a release mechanism for releasing the first clamping mechanism, and wherein the release mechanism is arranged such that the release mechanism is operated while operating the adjustment mechanism, wherein the release mechanism is arranged such that the release mechanism is released when the adjustment mechanism is released, wherein the adjustment mechanism comprises an adjustment bolt to be rotated for adjusting the position of the print head in the second direction, and wherein the release mechanism comprises an engagement surface arranged near the adjustment bolt such that the engagement surface is to be shifted for enabling operating the adjustment bolt.

3. The print head mounting assembly according to claim 2, wherein the adjustment bolt is to be operated by an elongated tool and the engagement surface is shiftable by engaging the adjustment bolt with the elongated tool at an angle and tilting the elongated tool to enable operation of the adjustment bolt, thereby shifting the engagement surface.

4. The print head mounting assembly according to claim 2, wherein the release mechanism comprises a lever, the lever comprising the engagement surface such that shifting the engagement surface operates the lever, the first clamping mechanism comprises a spring loaded element for exerting a spring load on the print head, and the lever is arranged to engage the spring loaded element for releasing the spring load when the lever is operated.

* * * * *